United States Patent [19]

Ellenberger et al.

[11] Patent Number: 4,729,411

[45] Date of Patent: Mar. 8, 1988

[54] AIR JET WEAVING MACHINE

[75] Inventors: Kurt Ellenberger, Wald; Georg Senn, Ruti, both of Switzerland

[73] Assignee: Sulzer Brothers Limited, Switzerland

[21] Appl. No.: 939,156

[22] Filed: Dec. 8, 1986

[30] Foreign Application Priority Data

Dec. 20, 1985 [CH] Switzerland ..... 05454/85

[51] Int. Cl.[4] ..... D03D 49/50

[52] U.S. Cl. ..... 139/116; 139/429; 139/194

[58] Field of Search ..... 139/1 R, 116, 435, 194, 139/302, 303, 429

[56] References Cited

U.S. PATENT DOCUMENTS 3,310,073 3/1967 Claeys ..... 139/429
3,677,306 7/1972 Atkinson .
4,448,223 5/1984 Deborde et al. ..... 139/435

FOREIGN PATENT DOCUMENTS 0094089 11/1983 European Pat. Off. .
0100939 2/1984 European Pat. Off. .
0161376 11/1985 European Pat. Off. .
969425 3/1950 France .

*Primary Examiner*—Henry S. Jaudon
*Attorney, Agent, or Firm*—Burns, Doane, Swecker & Mathis

[57] ABSTRACT

In an air jet weaving machine having: a picking nozzle (61, 62) outside the shed (15); and a weft yarn deflector (7, 90, 23) disposed between such nozzle and the shed (15) and operative to keep the weft yarn (5) away from the shed in response to a machine stop signal caused by a disturbance, a conveying line (22) for the deflected weft yarn (5) is received in the sley (10). The conveying line (22) is closed at its entry end by an end member (24) into which a funnel (23) of the weft yarn deflector leads. A receiver (30) having a suction or intake duct (32) is disposed at the exit end of the conveying line, the duct entry aperture being so dimensioned that the exit aperture of the conveying line (22) leads freely into the extraction or exhaust duct (32) in all positions of the sley (10).

4 Claims, 4 Drawing Figures

AIR JET WEAVING MACHINE

BACKGROUND

The invention relates to an air jet weaving machine having a picking nozzle outside the shed; and a weft yarn deflector disposed between such nozzle and the shed and response to a machine stop signal caused by a disturbance.

A weft yarn deflector operates by deflecting the weft yarn laterally by pneumatic or mechanical means into the shed transversely of the normal direction of weft movement, the deflected yarn being received by a suction line. Devices of this kind are described, for example, in European patent application No. 0 094 089.

Air jet weaving machines have, usually on the side where the weft yarn issues from the shed—i.e., on that side of the weaving machine which is opposite the picking nozzle—a suction extractor for the severed ends of the weft yarns. On the same side and for reasons of space, such weaving machines normally also have a suction extraction unit. To convey the weft yarn from the deflector to a collecting bin or the like in the extractor unit, a flexible line is usually secured inside the weaving machine. Even when flexible lines of this kind are compactly arranged, for example, on a longitudinal member of the frame, they may be a hindrance in cleaning and repair work.

SUMMARY OF THE DISCLOSURE

It is an object of this invention to provide a suction channel or paths for conveying the deflected weft yarn of an air jet weaving machine lengthwise of the sley in such a manner that the channel will not appear within the weaving width of the machine and therefore will not be able to cause any hindrance in maintenance work.

According to the invention, a conveying channel for the deflected weft yarn is formed in the sley. Since the weft yarn must be deflected at the level of the picking nozzle or reed, the conveying line is, conveniently, located immediately below the section of the sley in which the reed is clamped. A reed section of this kind having an internal duct can readily be devised, for example, as an aluminum article. Also, a reed section having an internal closed duct may have the advantage of being more resistant to twisting and bending deformations than an open reed section. Consequently, a conveying duct according to the invention saves a separate line and also helps to strengthen the sley without additional weight. The weft yarn, instead of being removed in the reed section, could be removed, for example, by way of a hollow drive shaft of the sley.

BRIEF DESCRIPTION OF THE DRAWINGS

The invention now will be described in greater detail with reference to the drawings wherein.

DETAILED DESCRIPTION OF A PREFERRED EMBODIMENT

Figure 1:
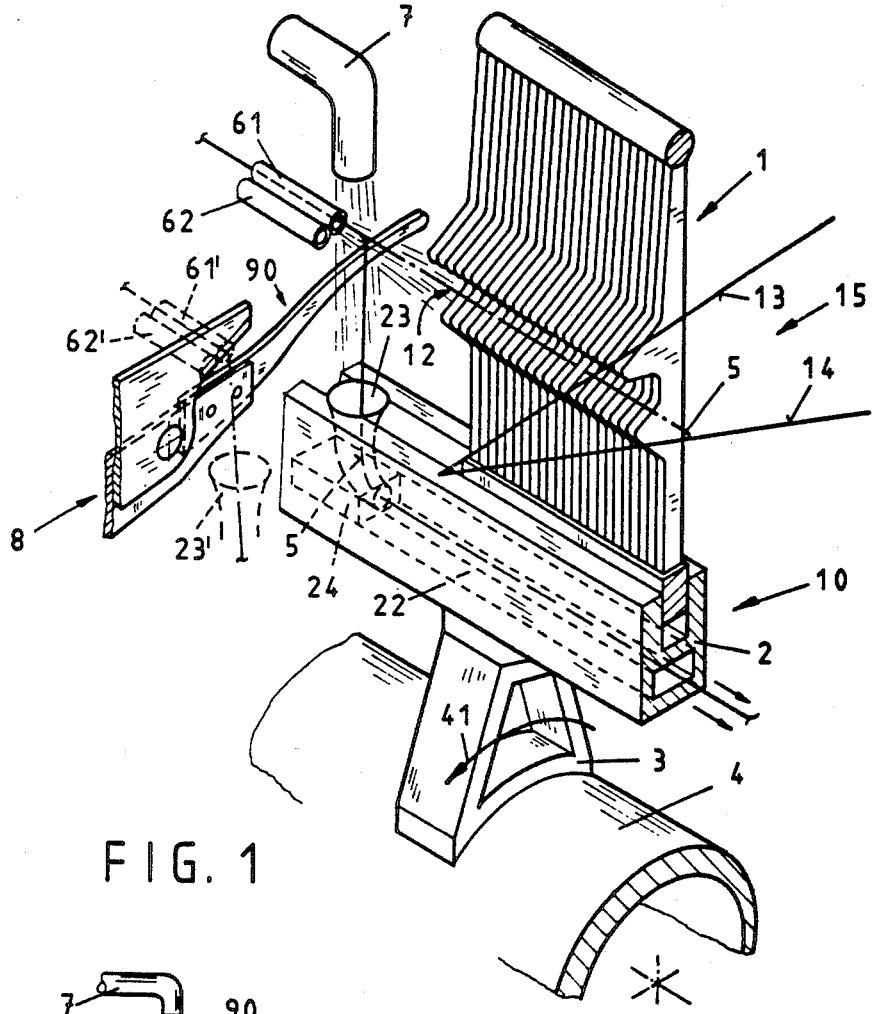
FIG. 1 is a perspective overview of the deflector for the weft yarn and of part of a sley with a conveying duct according to the invention.

FIG. 1 shows a part of a sley 10 near main nozzles 61, 62. A weft yarn deflector comprises a funnel 23 in reed profile or section 2, a yarn guide 90 and a blowing nozzle 7 directed downwardly towards the path of weft yarn 5. A system of this type is disclosed in U.S. application Ser. No. 939,134 of Hubert Peter Van Mullekom being filed concurrently herewith, and the entire disclosure of such application is incorporated herein by reference.

Reed 1 is secured in the reed section 2 and guide channel 12 of reed 1 guides the weft yarn 5 during picking. During picking the channel 12 is disposed in a shed 15 formed by tensioned warp yarns 13–14, disposed over the weaving width of the loom. Located therebelow in the reed section is a duct 22 operative as a line to convey the weft yarn after deflection. The reed section 2 is secured to sley shaft 4 by way of a number of levers 3.

Various kinds of faults, whether due to mechanical or control or textile reasons, which occur in a weaving machine require the stoppage thereof. Since air jet weaving machines in particular run relatively fast at e.g. 600 revolutions per minute, they cannot be braked abruptly. After a fault leading to automatic knocking-off of an air jet weaving machine has occurred, it is usually impossible to stop the machine fast enough to prevent the next pick from occurring. So that the machine operator loses as little time as possible before the machine restarts, the prepared weft pick is not inserted after the fault signal has been given. Instead, because of co-operation between the nozzle 7 and funnel 23, such pick does not come near the reed 1. The now operative nozzle 7 deflects the leading end of the weft yarn 5 towards the entry aperture of the funnel 23 through which air is drawn.

The entering air then flows together with the deflected weft yarn 5 through the cavity of an end member 24. In order to boost the suction at the entry to the funnel 23, the end member 24 can have an injector 25 which receives compressed air through a line 26. As will be apparent in FIGS. 3 and 4, the end member 24 is operative to deflect the yarn into a direction parallel to the length of the reed section 2 and to seal the line 22.

Figure 2:
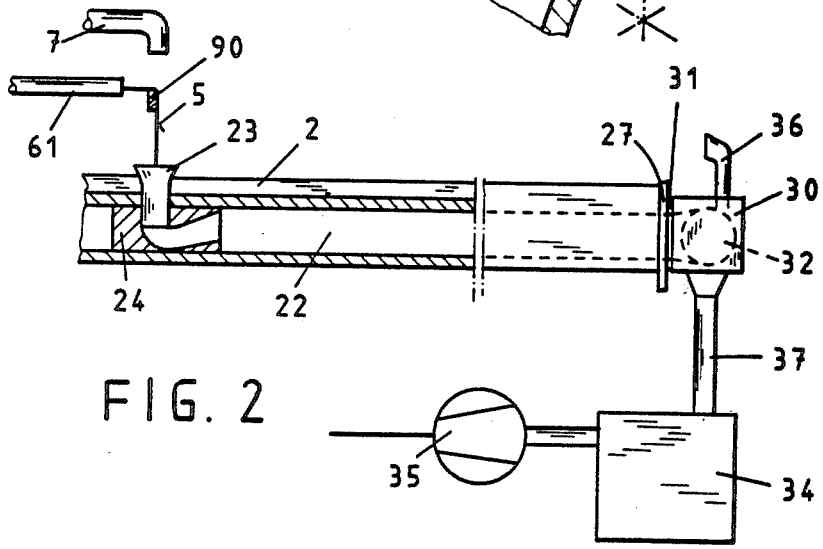
FIG. 2 is a diagrammatic overview of the deflecting system, the conveying line and the disposal station for the severed weft yarns.
Figure 3:
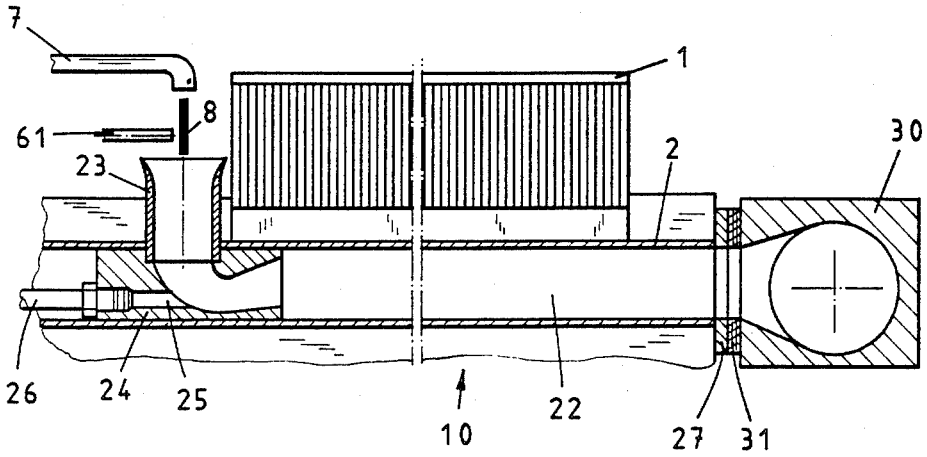
FIGS. 3 and 4 are partly sectioned views in elevation and plan respectively of a conveying duct for the deflected weft yarns, such duct being integrated into the reed section.
Figure 4:
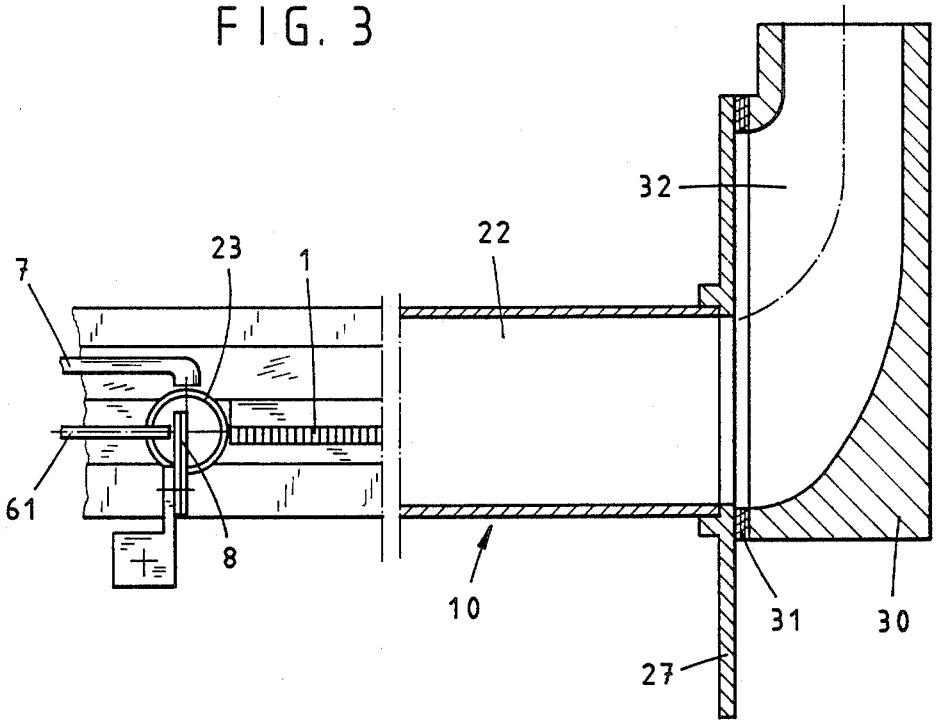

On the right-hand side of FIGS. 3 and 4, the line 22 is open towards a receiving member 30 in whose intake duct 32 the deflected weft yarn 5 is further deflected. This receiving member 30 does not move to and fro with the sley but is fixed relative to the frame of the weaving machine. Since the reed section 2 reciprocates with the reed 1 and the whole sley, the entry aperture of the duct 32 must be large enough for the exit aperture of the duct 22 to be opposite the entry aperture of the duct 32 without any cross-sectional narrowing in every movement phase throughout the entire range of movement of the sley. Moreover, the reed section 2 is provided with an end member 27 which screens off from atmosphere that part of the entry aperture of the suction duct 32 which the exit cross-section of the line 22 does not cover. A seal 31 between the receiving member 30 and the end member 27 prevents the intake of secondary air in this zone. The seal 31 can be made, for example, of plush. An intake bend 36 can lead to the receiving member 30, as shown in FIG. 2, and receive parts of the weft yarn after picking from this side of the sley. The deflected weft yarn goes from the member 30 through intake line 37 into a collecting bin or the like 34 which is connected to a fan 35 for producing the negative pressure in the intake lines 22–37.

FIG. 2 is a diagrammatic overall view of the deflector, the conveying line and the disposal system which is disposed thereafter and which comprises the bin 34 and fan 35. Between the main nozzle 61 and the funnel 23 the weft yarn 5 is deflected by way of a yarn guide 90 towards the end of the deflecting step, thus ensuring that the weft yarn enters shears 8 and is severed with the sley in its most forward position after rotation in the direction indicated by an arrow 41 in FIG. 1. In this position the main nozzle 61 delivering the weft yarn is disposed together with the second main nozzle 62 in the chain-line position 61' and 62' respectively near the shears 8; the funnel 23 is then in the position 23'. The deflection step ends with severance of the weft yarn.

Although this invention has been described with reference to an embodiment illustrated in some detail in the drawings, it will be evident that variations and modifications are possible. It is intended therefore that the scope of the invention be ascertained from the following claims.

What is claimed is:

1. An air jet weaving machine having a picking nozzle outside the shed at one side of the weaving machine; and a weft yarn deflector disposed between such nozzle and the shed and operative to keep the weft yarn away from the shed in response to a machine stop signal; a sley having a conveying duct therein for conducting the deflected weft yarn to the side of the weaving machine oposite the side at which said picking nozzle is located; a receiver disposed adjacent the exit end of the conveying duct and having a suction passage entry aperture so dimensioned that the exit aperture of the conveying duct leads freely into the suction passage in all positions of the sley; and an end member disposed on the sley at the end of the conveying duct and opposite the entry aperture into the receiver, said end member being so dimensioned that, in all positions of the conveying duct relative to the receiver, it covers those zones of the entry aperture into the suction passage which are not disposed opposite the exit aperture of the conveying duct.

2. A machine according to claim 1 including a funnel secured to the sley in the zone of said picking nozzle for receiving a deflected weft, and an end member in said conveying duct establishing fluid communication between said funnel and said conveying duct for facilitating the passage of a deflected weft from said funnel into said duct.

3. A machine according to claim 2, additionally including an injector extending into the last mentioned end member and blowing air therethrough for increasing the suction force in the funnel.

4. A machine according to claim 1, including a seal provided on the receiver between the said receiver and the end member of the conveying duct.

* * * * *